US005736930A

United States Patent [19]

Cappels

[11] Patent Number: 5,736,930

[45] Date of Patent: Apr. 7, 1998

[54] APPARATUS AND METHOD FOR RADIATION SOURCE FAILURE PREDICTION

[75] Inventor: Richard D. Cappels, San Jose, Calif.

[73] Assignee: Apple Computer, Inc., Cupertino, Calif.

[21] Appl. No.: 505,073

[22] Filed: Jul. 21, 1995

[51] Int. Cl.[6] ..... G08B 21/00

[52] U.S. Cl. ..... 340/642; 340/641; 364/551.01; 250/336.1; 250/369

[58] Field of Search ..... 340/642, 600, 340/578, 641, 643; 250/369, 336.1, 336, 312; 364/551.01

[56] References Cited

U.S. PATENT DOCUMENTS 4,172,226 10/1979 Rubin ..... 250/312
4,217,497 8/1980 Daniels et al. ..... 250/369
4,642,463 2/1987 Thoms ..... 250/336.1
4,862,004 8/1989 Koike et al. ..... 250/369

*Primary Examiner*—Jeffery Hofsass
*Assistant Examiner*—Davetta Woods
*Attorney, Agent, or Firm*—Carr & Ferrell LLP

[57] ABSTRACT

An apparatus for warning a user that a radiation source is likely to fail in the near future comprises a radiation source, having a radiance; a detector, responsive to the radiance; a memory, having a radiance measurement unit for collecting radiance data and a failure prediction unit for determining that the radiation source end of life is near; and a processing unit, coupled to the detector and the memory. A method for warning a user that a radiation source is likely to fail in the near future comprises the steps of collecting radiance data from the radiation source; determining if the radiation source's end of life is near; and warning a user if the radiation source's end of life is near.

20 Claims, 10 Drawing Sheets

APPARATUS AND METHOD FOR RADIATION SOURCE FAILURE PREDICTION

BACKGROUND OF THE INVENTION

1. Field of the Invention

The present invention relates generally to apparatus and methods for anticipating radiation source failure. More particularly, the present invention is an apparatus and method for warning a user that a radiation source is likely to fail in the near future.

2. Description of the Background Art

Modern visual presentation equipment (such as overhead projectors, movie film projectors and slide projectors) include lamps, bulbs or some sort of radiation source to project images. In the normal course of operating such equipment, the radiation source reaches an end of life condition where the radiation source has either "burnt-out" or lost so much of its output generation capability as to be ineffectual for its intended purpose. Of greater moment however, is an unexpected radiation source failure whose effects could range from a mere inconvenience to an economic disaster, such as when a potential customer has only a short window of time for watching one's new product presentation.

To minimize the likelihood of an unexpected radiation source failure, some manufactures have attempted to warn the user of possible near term radiation source failure, so that the user could replace the radiation source before it failed. Some warning devices use a timer to simply monitor how long the radiation source has operated and then output a warning signal after a fixed and rigid time period, the time period being based on the radiation source's average predicted lifetime. The drawback to this approach, however, is that different radiation sources have different lifetimes and often can be defective and fail well before their average predicted lifetime. Other devices warn the user after the radiation source radiance output has dropped by a fixed percentage from its "when new" radiance output. The drawback to this approach is that depending upon the failure characteristics of the radiation source, the user warning could be generated too early for the radiation source whose radiance has dropped below the fixed percentage but still has up to one-half of its life remaining. Similarly, the warning could be generated too late for a defective radiation source that is in the process of quickly failing, even before its luminance has dropped by the fixed percentage. Thus, when a user is warned too early, needless time and expense is spent replacing the radiation source that may have had hundreds of hours left in it. However, when a user is warned too late, then radiation source failure may occur too rapidly for the user to even finish his/her presentation before failure occurs. In the most complex version of the fixed percentage approach known, the manufacturer sets the fixed percentage drop at the factory by adjusting a potentiometer within the projector based on the installed radiation source's initial radiance. However, this potentiometer is typically not reset each time the user installs a new radiation source in the field, since to do so would require special test equipment and well-controlled lighting conditions that for a typical user would be quite impractical. An improperly set potentiometer is a problem, since each radiation source's initial radiance typically varies over a wide range. For example, for a fixed potentiometer setting, what may have been a 10% drop for the factory installed radiation source could become an 8% or 12% drop for a replacement radiation source, respectively resulting in the user being warned too early or too late, with the resultant effects as discussed above.

What is needed is an apparatus and method for predicting the failure of a radiation source based upon individual radiation source characteristics, resulting in a significantly more accurate end of life prediction.

SUMMARY OF THE INVENTION

The present invention is an apparatus and method for warning a user that a radiation source is likely to fail in the near future. The apparatus of the present invention preferably comprises a radiation source, having a radiance; a detector, responsive to the radiance; a memory, having a radiance measurement unit for collecting radiance data and a failure prediction unit for determining that the radiation source end of life is near; and a processing unit, coupled to the detector and the memory. The method of the present invention preferably comprises the steps of collecting radiance data from the radiation source; determining if the radiation source's end of life is near; and warning the user if the radiation source's end of life is near.

DETAILED DESCRIPTION OF THE PREFERRED EMBODIMENT

The present invention is an apparatus and method for maintaining and analyzing a record of a radiation source's radiance as a function of its operating time. The present invention is particularly advantageous over the prior art because it tailors the end of life prediction for the radiation source to its initial radiance and unique aging characteristics. Thus, the present invention not only avoids the premature replacement of radiation sources that may have up to 50% of their useful life left, it gives an early warning for defective radiation sources that may be failing prematurely. The present invention also permits radiation sources to be exchanged between projectors while retaining their respective radiance records; automatically normalizes the radiation source's radiance record to compensate for variances between different projectors; and presents radiation source manufacturers with a wealth of real-world operating data, thus aiding improvements in their manufacturing techniques and warranty calculations.

Figure 1:
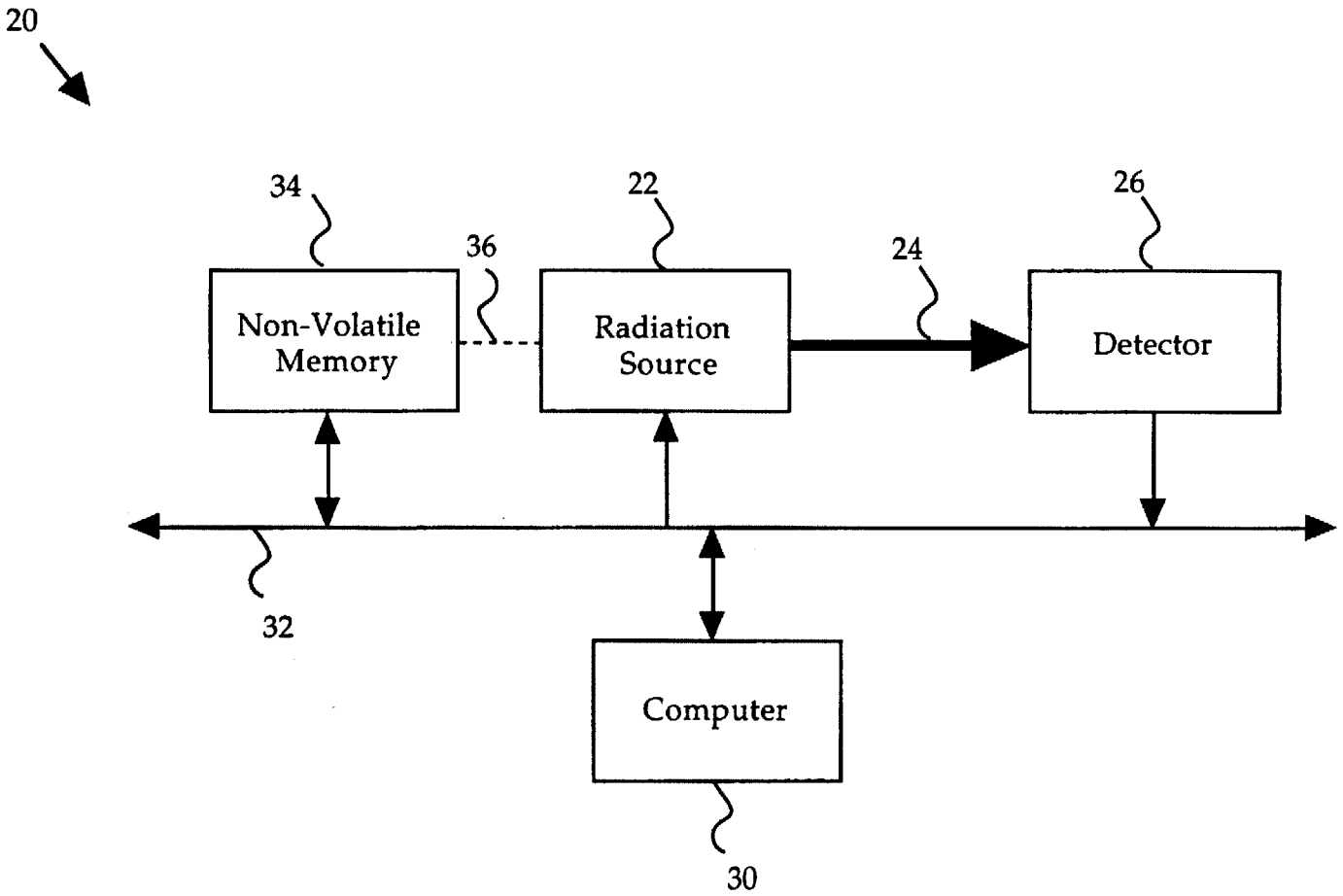
FIG. 1 is a block diagram of a preferred embodiment of an apparatus for radiation source failure prediction.

Referring now to FIG. 1, a block diagram of a preferred embodiment of an apparatus 20 for radiation source failure prediction, referred to herein as an End of Life Unit (ELU) 20, is shown. The ELU 20 comprises a radiation source 22, a detector 26, a computer 30 and a non-volatile memory (NVM) 34. The ELU 20 is preferably housed within a projector (not shown). The radiation source 22 generates a radiance 24 that is received by the detector 26. In the preferred embodiment, the radiation source 22 is a light source (such as a lamp or a bulb) and the radiance 24 includes visible light (i.e. luminance). However, those skilled in the art will recognize that, in general, the present invention is applicable to any radiation source that generates an output capable of being detected. Such alternate embodiments include radiation sources in factory lighting fixtures, plasma displays, X-ray machines and calibration references.

The radiation source 22 is coupled via a bus 32 to the computer 30, such that the computer 30 may inhibit operation of the radiation source 22 should the NVM 34 not be present. This assures that the radiation source 22 will not be used without its radiance history being kept. It also means that in the preferred embodiment, only radiation sources 22 equipped with the NVM 34 can be used in the projector.

The detector 26 receives the radiance 24 and generates an output signal to the computer 30 via the bus 32. The detector's 26 output signal is proportional to the radiance 24. The detector 26 is preferably an infra-red detector mounted behind a "cold-mirror," so as not to interfere with the delivery of the radiance 24 to a projection screen. Alternate embodiments of the present invention could mount the detector 26 behind a partially silvered mirror, based on the just mentioned goal of not interfering with the delivery of radiance 24 to the projection screen.

The NVM 34 receives radiance data from the computer 30 via the bus 32. The NVM 34 is preferably physically coupled to the radiation source 22 as shown by the dashed line 36. In a first exemplary embodiment, the NVM 34 is physically coupled to the radiation source 22 by a short wire or cable. In a second exemplary embodiment, the NVM 34 is physically mounted upon a housing in which the radiation source 22 resides. The physical coupling between the radiation source 22 and the NVM 34 is preferred so that when the radiation source 22 is either replaced or moved to another projector, the radiation source's 22 unique radiance characteristics, as reflected in the radiance data stored in the NVM 34, are preserved. Each unique set of radiance data is retained to support the present invention's ability to predict the end of life for the particular radiation source 22, as is elaborated upon infra. In the preferred embodiment the NVM 34 is an Electrically Erasable Programmable Read Only Memory (EEPROM), such as that manufactured by Phillips (part #: PCD8594D2Y). However, in an alternate embodiment the NVM 34 could be a single potentiometer, adjusted to provide the computer 30 with a reference translatable to a fixed radiance value. In this alternate embodiment, if the measured radiance 24 falls below the fixed radiance value, the user would be warned that the radiation source's 22 end of life is near.

Figure 2:
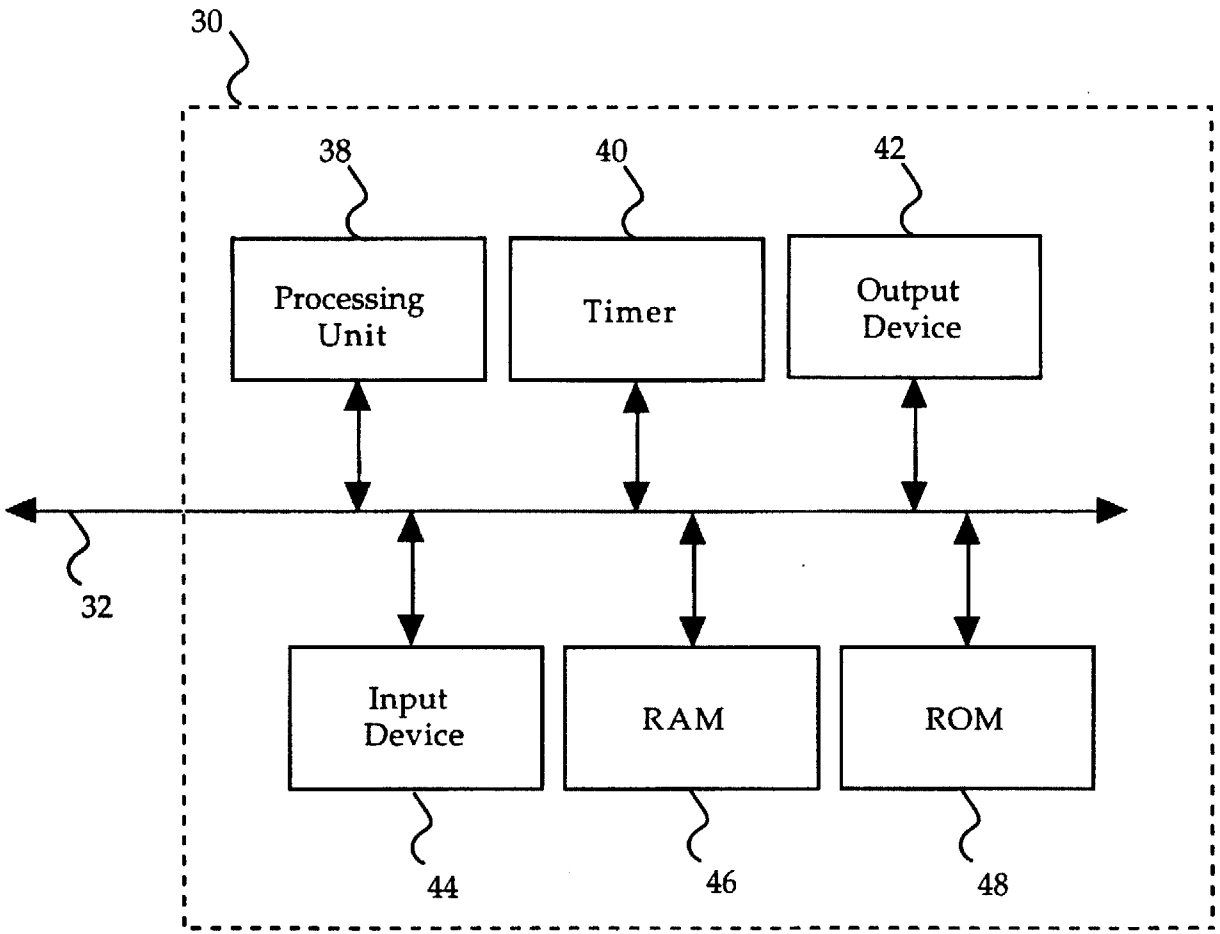
FIG. 2 is a block diagram of a preferred embodiment of a computer of the present invention.

Referring now to FIG. 2, a block diagram of a preferred embodiment of the computer 30 of the present invention, is shown. The computer 30 comprises a processing unit 38, a timer 40, an output device 42, an input device 44, a Random Access Memory (RAM) 46, and a Read Only Memory (ROM) 48, each coupled via the bus 32. The computer 30 receives the detector's 26 output signal, transforms it into a radiance data point, and transfers radiance data over the bus 32 to be stored in the NVM 34. In addition, the computer 30 interprets the radiance data and generates an end of life warning signal based on the stored radiance data in a manner described in detail below. In the preferred embodiment, the computer 30 resides within the projector; however, those skilled in the art will recognize that in an alternate embodiment, a stand-alone personal computer could carry out all of the computer's 30 functions. The processing unit 38 executes programming instructions stored in the ROM 48 to perform initialization, normalization, measurement and end of life warning operations, as described in detail below. The timer 40 generates a time signal that can be accessed by the processing unit 38, for use in calculating when radiance 24 sampling is to occur. In the preferred embodiment, the timer 40 comprises a conventional counter. The output device 42 receives the end of life warning signal from the processing unit 38 and generates a warning to the user. In the preferred embodiment the output device is a light emitting diode; however, alternate embodiments could present information to the user on any type of display device, such as those conventionally known in the prior art. The input device 44 is preferably a serial port which allows the user to connect a remote control unit or a host computer to the projector. The input device 44 could be used to power-on/off the projector and control various other projector operations, as are conventionally known in the art. The RAM 46 contains memory locations suitable for storing intermediate results generated by the processing unit 38. The ROM 48 is a computer readable medium which preferably contains programming instructions that control how the processing unit 38 accesses, transforms and outputs data, as described in detail below. Those skilled in the art will recognize that in alternate embodiments the ROM 48 could be replaced with a functionally equivalent device such as: a compact disk and drive; a hard disk and drive; a floppy disk and drive; and/or a memory card. Alternate embodiments of the computer 30 could also incorporate both the ROM 48 and a disk drive of some sort.

Figure 3:
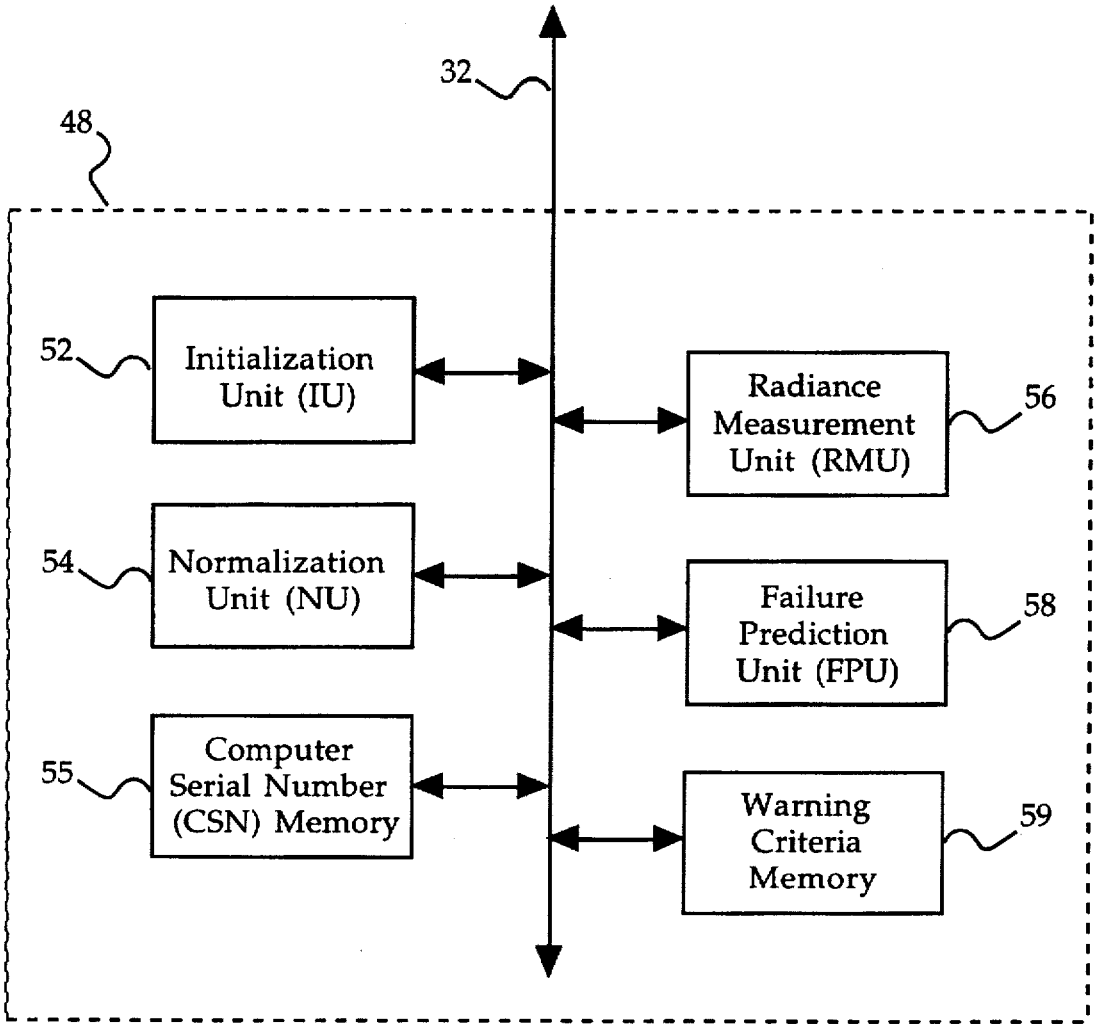
FIG. 3 is a block diagram of a preferred embodiment of a Read Only Memory within the computer.

Referring now to FIG. 3, a block diagram of a preferred embodiment of the ROM 48 within the computer 30 is shown. The ROM 48 comprises an initialization unit (IU) 52, a normalization unit (NU) 54, a computer serial number (CSN) memory 55, a radiance measurement unit (RMU) 56, a failure prediction unit (FPU) 58 and a warning criteria memory 59, each of which are coupled to the bus 32. In the preferred embodiment, the IU 52, NU 54, RMU 56 and FPU 58 comprise programming instructions stored in the ROM 48 and executable by the processing unit 38. The IU 52 selectively performs initialization operations upon power-on of the projector. The NU 54 then selectively performs normalization operations. The RMU 56 collects radiance data points, and the FPU 58 determines whether the radiation source's 22 end of life is near. The detailed operations performed by the IU 52, NU 54, RMU 56 and FPU 58 are described below. In addition, the use of the CSN memory 55 and the warning criteria memory 59 are also elaborated upon infra.

Figure 4:
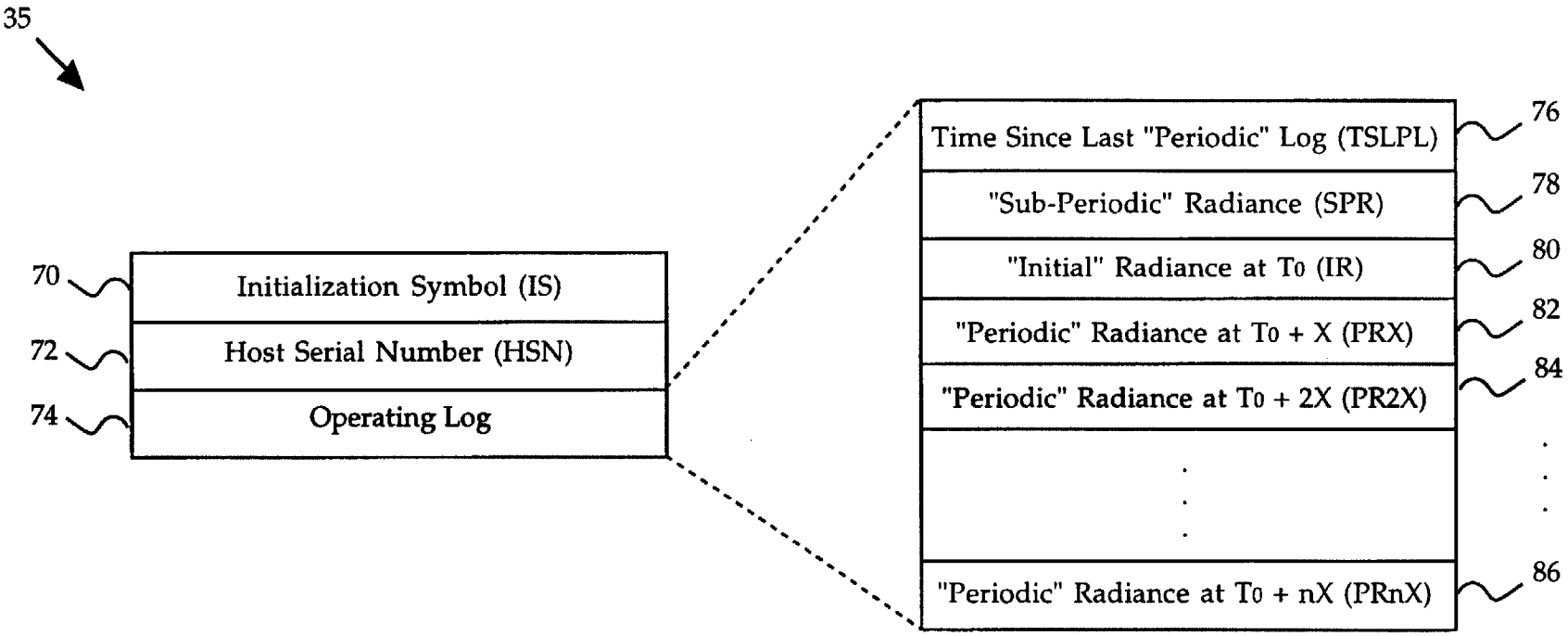
FIG. 4 is a block diagram of a preferred embodiment of a non-volatile memory data structure of the present invention.

Referring now to FIG. 4, a block diagram of a preferred embodiment of an NVM data structure 35 of the present invention is shown. The NVM data structure 35 resides within the NVM 34 and comprises an initialization symbol (IS) data field 70 for storing an initialization symbol (IS), a host serial number (HSN) data field 72 for storing a host serial number (HSN), and an operating log data field 74 for storing an operating log. The operating log data field 74 is further comprised of: a time since last periodic log (TSLPL) data field 76 for storing a time since last periodic log (TSLPL); a sub-periodic radiance (SPR) data field 78 for storing a sub-periodic radiance (SPR); an initial radiance at To (IR) data field 80 for storing an initial radiance at To (IR) where To is the time at which the first radiance 24 data point was captured; a periodic radiance at To+X (PRX) data field 82 for storing a periodic radiance at To+X (PRX) where X is the interval between subsequent radiance data point captures; a periodic radiance at To+2X (PR2X) data field 84 for storing a periodic radiance at To+2X (PR2X); and a periodic radiance at To+nX (PRnX) data field 86 for storing a periodic radiance at To+nX (PRnX), where n is preferably an integer. Between the PR2X data field 84 and the PRnX data field 86 there exist any number of additional data fields for storing additional periodic radiance data points, the number of additional data fields limited only by the memory capacity of the NVM 34. Also note that while in the preferred embodiment X is constant, an alternate embodiment may vary X such that X decreases over time, resulting in more periodic radiance data points being collected as the radiation source 22 ages. Such an embodiment allows the ELU 20 to more closely monitor the radiation source 22 as it nears its end of life. In the paragraphs to follow, the manner in which each of the aforementioned data fields 70, 72, 74, 76, 78, 80, 82, 84, 86 are operated upon by the units 52, 54, 56 58 within the ROM 48 is described in detail.

Figure 5:
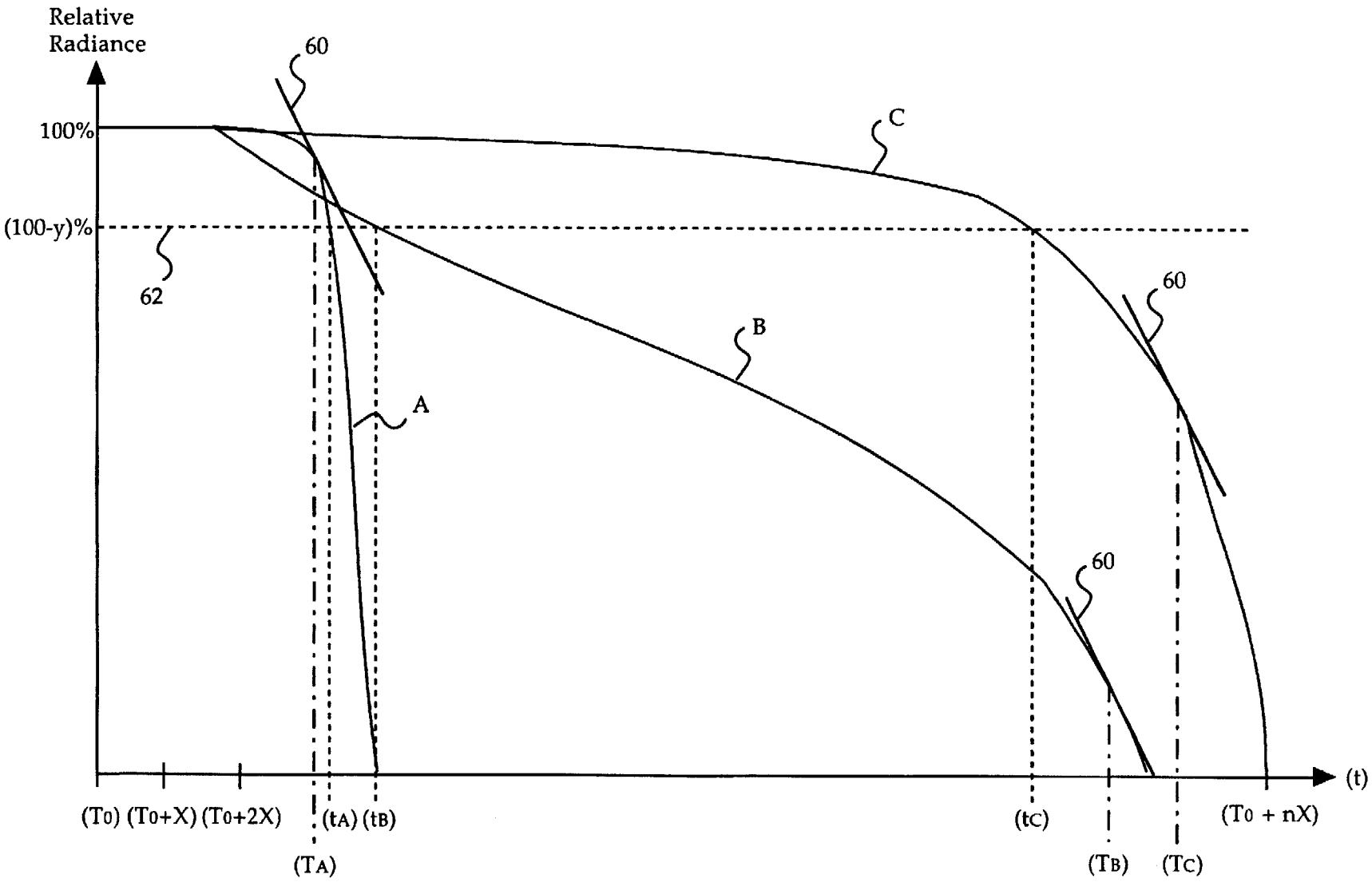
FIG. 5 is a graph of three exemplary radiance curves.

Referring now to FIG. 5, a graph of three exemplary radiance curves is shown. Herein, the three exemplary radiance curves are referred to as A, B and C. A first axis shows the time (t) and a second axis shows the relative radiance as a percentage, where 100% corresponds to the radiation source's radiance 24 when "new." Radiance curve A shows a radiation source 22 that has prematurely failed. Radiance curve B shows a somewhat average-life radiation source 22. And radiance curve C shows a somewhat long-life radiation source 22. Each of these radiance curves will be elaborated upon as appropriate below.

Upon projector power-up, the IU 52 determines whether the NVM 34 is present within the projector, and if it is not, the IU 52 preferably inhibits operation of the radiation source 22 via the bus 32. This assures that the radiation source is not used without its radiance data being kept. However, it also means that, in the preferred embodiment, only radiation sources equipped with the NVM 34 can be used in the projector. The IU 52 also checks the IS data field 70, shown in FIG. 4, for the IS. The IS is a bit pattern that is used to determine if the NVM 34, and its physically coupled radiation source 22, have ever been used in any projector before. The IS is preferably chosen so that its bit pattern is unlikely to occur in a new NVM 34. Those skilled in the art will recognize that the NVMs 34 are typically manufactured such that all of their data field bits are initially set to either a logic state "1" or a logic state "0." Also, before the NVM's 34 installation into an electronic device, the bits change only as a result of an electrostatic discharge (ESD) event. Thus, in the preferred embodiment, the present invention employs "10101010 01010101 11110000 00001111 11001110 01100111 01010101" as the IS. As a person of ordinary skill in the art would know, the length of this symbol and its bit pattern make it highly unlikely that the new NVM 34 would experience a series of ESD events resulting in this IS, due to the nature of ESD events on memory chips as is conventionally known. Preferably, there is a different IS for each different type of radiation source 22 employed by the projector. If, after checking the IS data field 70, the IS is found in the NVM 34, the IU 52 issues a signal to the processing unit 38 to transfer control to the NU 54. However, if no IS is found in the NVM 34, the IU 52: sets a flag in the RAM 46 indicating that the NVM 34 is "new"; erases the entire NVM 34; and writes the IS to the IS data field 70 and a HSN into the HSN data field 72. The IU 52 then issues a signal to the processing unit 38 to transfer control to the NU 54. Note, the HSN written to the HSN data field 72 corresponds to a computer serial number CSN stored in the CSN memory 55, as is discussed hereafter.

The normalization unit (NU) 54, after receiving control from the IU 52, retrieves the HSN from the HSN data field 72. The NU 54 compares the HSN with the CSN stored in the CSN memory 55. Note, in the preferred embodiment the computer 30 within each different projector has its own unique CSN stored in the CSN memory 55. This CSN may either be assigned to the projector at the factory as a unique number or it can be a pseudo-random number generated by the computer 30 itself the first time the projector is powered-on. Each projector's unique CSN allows the projector to determine whether the radiation source 22 has been swapped from a prior projector just by comparing the HSN with the CSN. If the HSN matches the CSN, the NU 54 determines that the radiation source 22 has not been transferred from a prior projector in which the present invention resides, and the NU 54 signals the processing unit 38 to transfer control to the RMU 56. However, if the HSN does not match the CSN, then the radiation source 22 has been transferred from a prior projector and the NU 54 must normalize the radiance data stored in the operating log data field 74. In an alternate embodiment, the CSN would not be associated with the projector; instead, each radiation source 22 would have its own unique serial number which the computer 30 would copy and store in a separate non-volatile memory located within the computer 30. The next time the projector is powered-on, the computer 30 would compare the radiation source 22 serial number previously stored with the currently installed radiation source 22 serial number, and if different, conclude that a different radiation source 22 has been installed in the projector.

Normalization is a process of compensating for differences in detector sensitivities between projectors. Normalization eliminates the need to precisely calibrate each projector's detector 26. In the preferred embodiment, the NU 54 performs normalization operations by first measuring the radiance 24 of the radiation source 22 after the radiation source 22 has reached its normal operational state, that is, after the radiation source 22 has "warmed-up." The radiance 24 measured after the warm-up period is referred to herein as a current radiance. In the preferred embodiment, the NU 54 preferably determines whether the radiation source 22 has reached its normal operational state by examining the timer 40 to determine whether a predetermined period has elapsed. Those skilled in the art will recognize that in alternate embodiments, a warm-up determination can be made by measuring the temperature of the radiation source 22 or monitoring the spectrum of the radiance 24 emitted from the radiation source 22.

After the current radiance is measured, the NU 54 retrieves the SPR from the SPR data field 78. Then, the contents of the SPR data field 78, the IR data field 80, the PRX data field 82, and the PR2X data field 84 through the PRnX data field 86 are multiplied by the ratio: (current radiance/SPR) to generate normalized radiance data. This normalized radiance data is written over the non-normalized radiance data, retaining the same ordering as when the non-normalized radiance data was initially recorded. The normalization in the preferred embodiment, as described above, compensates for gain variances between detectors 26 in different projectors. Those skilled in the art will recognize that an alternate embodiment could also compensate for both "fixed and "non-fixed" detector 26 offset errors. "Fixed" offset errors could be accommodated if the data structure shown in FIG. 4 was modified to include data fields describing the offset errors. In addition, other "non-fixed" offset errors, such as thermally induced dark current drift, can be compensated for by providing additional data fields in the NVM data structure 35 for the necessary coefficients and adding any necessary sensors conventionally known in the art. Upon completion of the normalization operations, the NU 54 transfers control to the RMU 56.

The radiance measurement unit (RMU) 56 performs the actual collection of radiance data generated by the detector 26, after the radiation source 22 has warmed-up. The RMU 56 checks the flag in RAM 46 to determine whether the radiation source 22 and its associated NVM 34 have been declared "new." If so, an IR data point is captured and stored in the IR data field 80. Note, in an alternate embodiment, the RMU 56 checks the IR data field 80 and if the IR is set to predetermined value, for example all zero's, the RMU 56 would assume that the radiation source 22 was "new" and thus capture the IR data point and store it in the IR data field 80. The IR is shown in FIG. 5 as the 100% relative radiance point at time(t) To. Following capture of the IR, or if the radiation source 22 had not been declared "new," the RMU 56 determines whether it is time to capture a new SPR radiance data point and store it in the SPR data field 78. The time interval between sequential captures of the SPR, called a sub-periodic sampling interval, is preferably stored in the warning criteria memory 59 in the ROM 48. In the preferred embodiment, the warning criteria memory 59 contains warning criteria for only one radiation source 22; however, alternate embodiments may contain warning criteria for multiple radiation sources 22. The sub-periodic sampling interval chosen is based on a trade-off between a desired accuracy of the normalization operations or the FPU 58 calculations and the NVM's 34 cost. In the preferred embodiment, the sub-periodic sampling interval is chosen so that the radiation source's 22 radiance 24 decreases by no more than one-percent between sequential captures of the SPR. If it is time to capture the new SPR, the RMU 56 records the signal output by the detector 26 and updates the TSLPL value in the TSLPL data field 76, shown in FIG. 4. The TSLPL is preferably defined to be the number of hours elapsed since the most recent periodic radiance data point capture (i.e. either the IR, PRX, PR2X or PRnX, whichever is most current) and the current recording of the SPR. For example, if the new SPR was just captured, then TSLPL would be set to zero.

Next, the RMU 56 determines whether it is time to record a new periodic radiance data point. Note that the complete set of periodic radiance values (i.e. PRX, PR2X and PRnX) plus the IR and the SPR comprise the radiance data which is later accessed by the FPU 58 to predict the end of life of the radiation source 22. The periodic sampling interval (X), is preferably stored in the warning criteria memory 59 in the ROM 48. However, in an alternate embodiment, the NVM 34 would come pre-loaded with the periodic sampling interval (X) appropriate for the attached radiation source 22. The periodic sampling interval (X) chosen is based on a tradeoff between a desired accuracy of the FPU 58 calculations and the NVM's 34 cost. The periodic sampling interval (X) used is also based on the failure modes of the type of radiation source 22 being used. In the preferred embodiment the periodic sampling interval is a fixed percentage of predicted radiation source 22 life. In an alternate embodiment, the periodic sampling interval (X) would be a linear or nonlinear function of operating time or relative light output. The nonlinear sampling approach would require additional data fields in the NVM data structure 35, including data fields describing the measurement intervals. Once the periodic sampling interval (X) is chosen, the RMU 56 collects the radiance data. More specifically, after the IR is captured and stored in the IR data field 80, the RMU 56 waits for a time period equal to the periodic sampling interval (X) before capturing the PRX and storing it in the PRX data field 82, waits for another time period equal to the periodic sampling interval (X) before capturing the PR2X and storing it in the PR2X data field 84, and so on, until PRnX is captured and stored in the PRnX data field 86. For the purposes of this discussion, PRnX is presumed to be the last radiance data point captured before the radiation source 22 is removed from the projector. Variable "n" is preferably an integer. FIG. 5 shows three examples (i.e., radiance curves A, B and C) of how the radiance data stored in the NVM data structure 35 might appear when plotted.

The failure prediction unit (FPU) 58, shown in FIG. 3, analyzes the radiance data collected by the RMU 56. The basic function of the FPU 58 is to determine when the end of life of the radiation source 22 is near, based on the radiance data collected by the RMU 56. In the preferred embodiment the FPU 58 calculates a current slope of the radiance curve using the two most recently recorded radiance data points. Alternate embodiments may perform some sort of smoothing on the radiance data before calculating the slope. Referring to FIG. 5, if the FPU 58 determines that the current slope is greater than or equal to a maximum allowable slope 60, which is retrieved from the warning criteria memory 59, the FPU 58 generates a warning signal to the user via the output device 42 to indicate that radiation source 22 failure is near. For example, in FIG. 5, assuming that the maximum allowable slope 60 is as shown, the FPU 58 generates the warning signal at time ($T_A$) for radiance curve A, at time ($T_B$) for radiance curve B, and at time ($T_C$) for radiance curve C. As can be seen in FIG. 5, the present invention thus bases its warning signals on the unique characteristics of each radiance curve. Note that the maximum allowable slope 60 is preferably stored in the warning criteria memory 59 or alternatively stored in the NVM 34 and chosen based on a study of the radiance 24 verses time curves produced by the manufacturer for each radiation source 22. More specifically, the maximum allowable slope 60 is chosen after reviewing the radiance data from a statistically significant number of radiation sources (i.e. about 20 to 100 radiation sources will be analyzed, depending upon the variability of the radiation sources' radiance data slopes just prior to failure). The maximum allowable slope 60 is chosen such that it would reliably predict the failure of the vast majority of radiation sources reviewed.

In the preferred embodiment, the FPU 58 also generates the warning signal if the most recently recorded radiance data point falls below some fixed percentage of the IR stored in the IR data field 80. For instance, referring to FIG. 5, if the aforementioned fixed percentage is set to y% 62, then the FPU 58 generates the warning signal at time ($t_A$) for radiance curve A, at time ($t_B$) for radiance curve B, and at time ($t_C$) for radiance curve C. In this alternate embodiment, y% is preferably 10%. The y% 62 value is preferably stored in the warning criteria memory 59.

Figure 6:
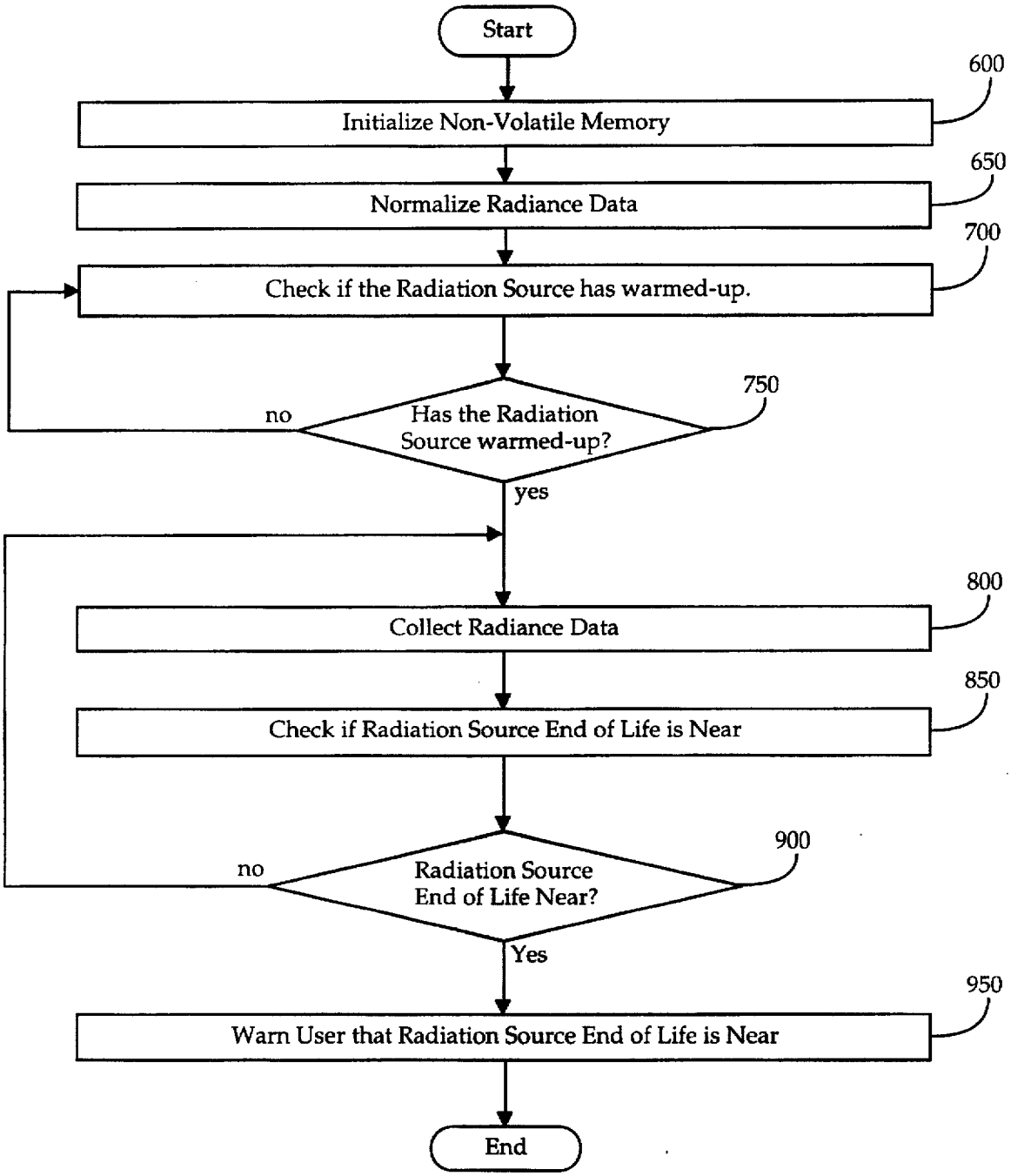
FIG. 6 is a flowchart of a preferred method for radiation source failure prediction.

Referring now to FIG. 6, a flowchart of a preferred method for radiation source failure prediction is shown. The preferred method begins in step 600 where the IU 52 initializes the NVM 34. Step 600 is described in detail below in FIG. 7. Next, in step 650, the NU 54 normalizes the radiance data. Step 650 is described in detail in FIG. 8. In step 700, the NU 54 checks whether the radiation source 22 has warmed-up in the manner previously described. In step 750, if the radiation source 22 has not warmed-up, the preferred method returns to step 700. If the radiation source 22 has warmed-up, radiance data is collected by the RMU 56 in step 800. Step 800 is described in detail below in FIG. 9. Next, in step 850, the FPU 58 checks if the radiation source's 22 end of life is near. Step 850 is described in detail below in FIG. 10. If, in step 900, the radiation source's 22 end of life is not near, the preferred method returns to step 800. However, if, in step 900, the radiation source's 22 end of life is near, the method proceeds to step 950 where the FPU 58 warns the user that end of life for the radiation source 22 is near, in the manner discussed earlier in this document. After step 950, the preferred method ends.

Figure 7:
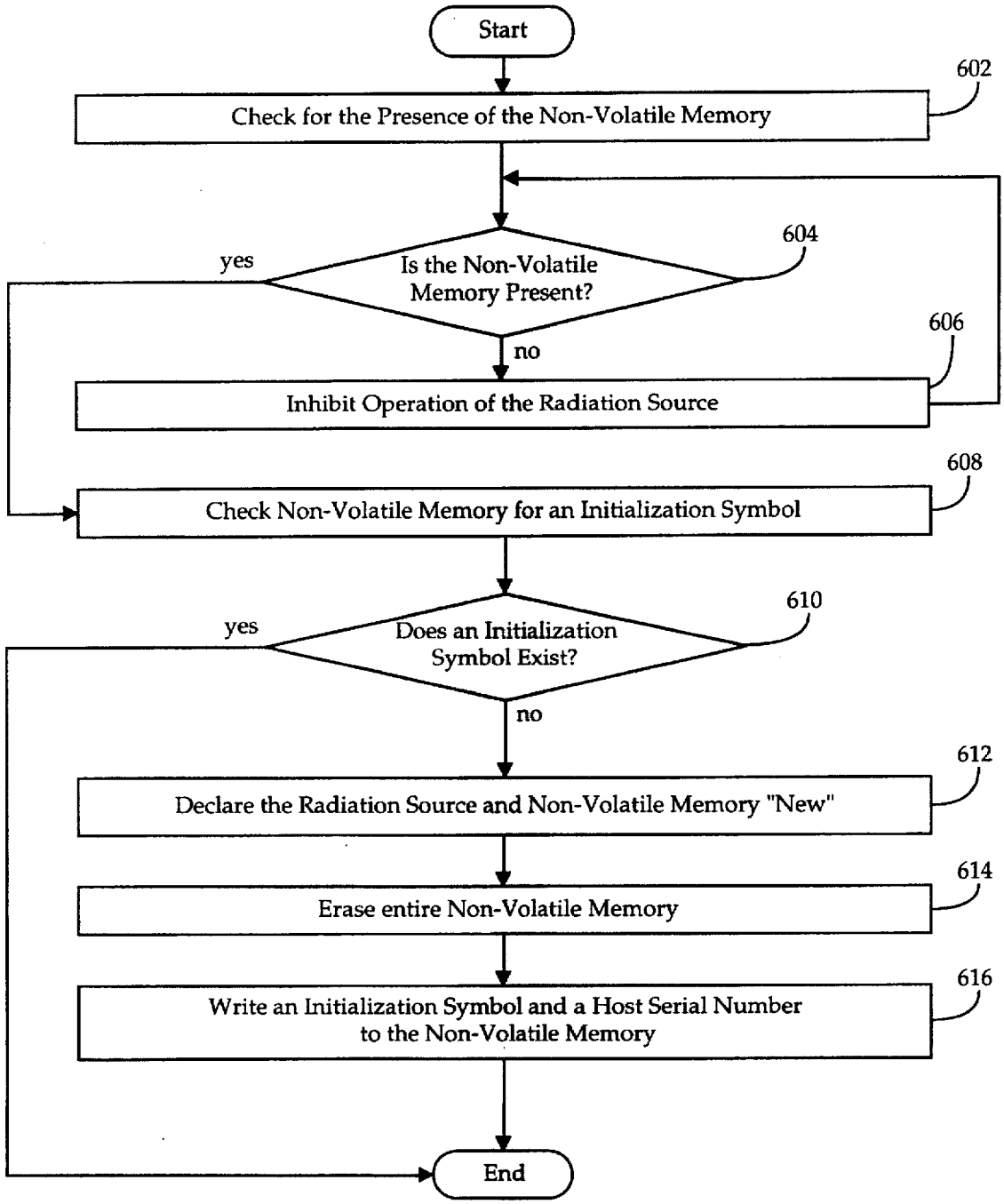
FIG. 7 is a flowchart of a preferred method for initializing non-volatile memory.

Referring now to FIG. 7, a flowchart of a preferred method for initializing the NVM 34 (step 600 of FIG. 6) is shown. The preferred method begins in step 602 with the IU 52 checking for the presence of the NVM 34. The IU 52 performs this check by first reading an NVM memory address where the IS is normally stored. If no IS is found at this location, the IU 52 performs a trial write of the IS to the NVM memory address. Then the IU 52 reads the NVM memory address. If the IS just written is read back, then the NVM 34 is present, else it is not. If, in step 604, the NVM 34 is not present, the method proceeds to step 606 where step 606 where the IU 52 inhibits operation of the radiation source 22. The IU 52 inhibits the radiation source 22 via an on/off logic signal connected to the radiation source's 22 power supply. After step 606, the method returns to step 604. If, in step 604, the NVM 34 is present, the method proceeds to step 608 and the IU 52 checks the IS data field 70 for the IS. In step 610, if the IS data field 70 contains the IS, the preferred method ends. However, in step 610, if the IS is not present in the IS data field 70, the method proceeds to step 612 where the IU 52 declares the radiation source 22 and NVM 34 "new" by setting a flag in RAM 46. Next, in step 614, the IU 52 erases the entire NVM 34. In step 616, the IU 52 writes the IS to the IS data field 70 and the HSN, which is by default equivalent to the CSN, to the HSN data field 72. After step 616, the preferred method ends.

Figure 8:
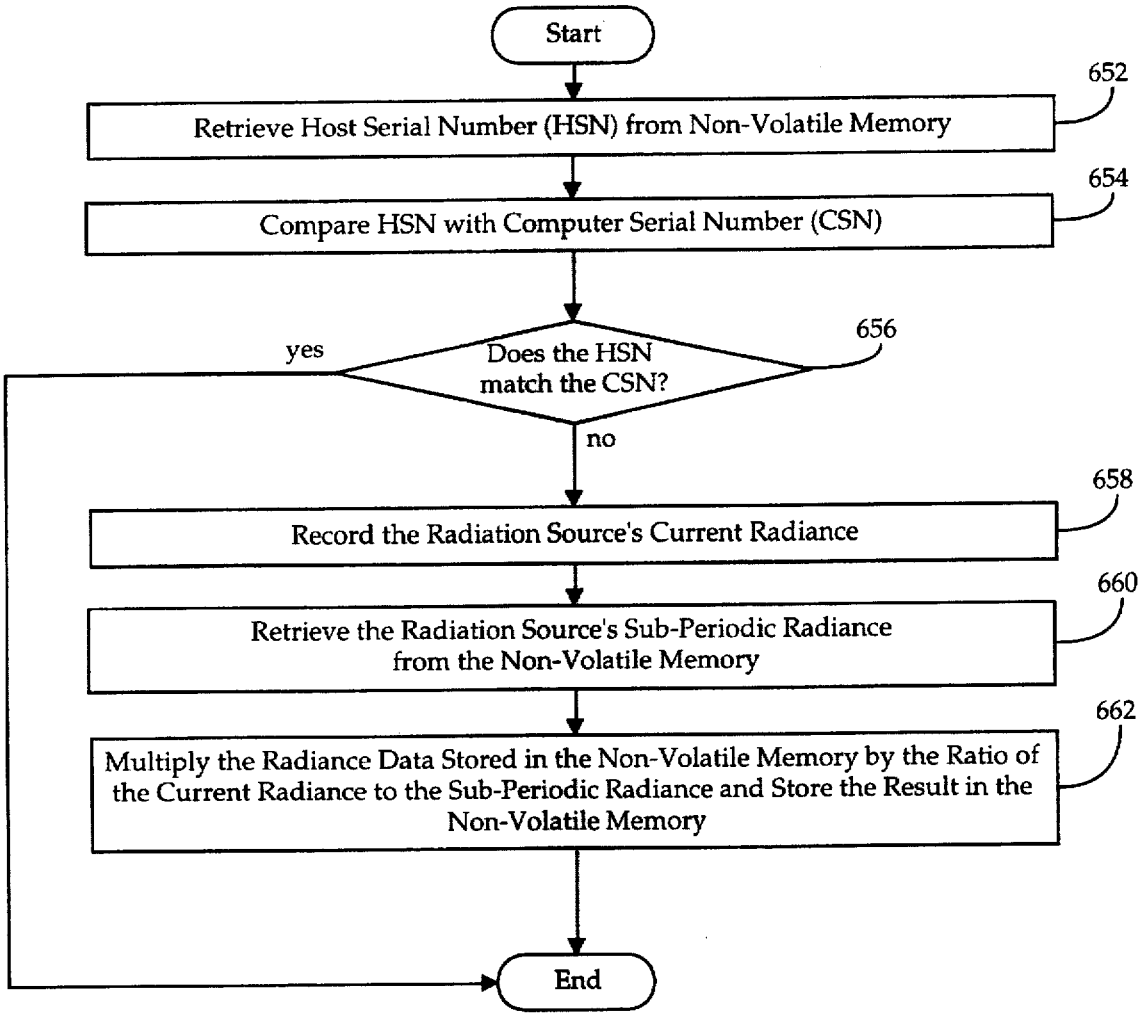
FIG. 8 is a flowchart of a preferred method for normalizing radiance data.

Referring now to FIG. 8, a flowchart of a preferred method for normalizing the radiance data (step 650 of FIG. 6) is shown. The preferred method begins in step 652 with the NU 54 retrieving the HSN from the HSN data field 72. In step 654 the NU 54 compares the HSN with the CSN. If, in step 656, the HSN matches the CSN, the method ends. However, if, in step 656, the HSN does not match the CSN, the method proceeds to step 658 where the NU 54 records the radiation source's 22 current radiance. In step 660 the NU 54 retrieves the radiation source's 22 SPR from the SPR data field 78. In step 662, the NU 54 multiplies the IR, SPR, PRX, and PR2X through PRnX radiance data, presently stored in the NVM data structure 35, by the ratio of the current radiance, as measured in step 658, to the presently stored SPR. Also in step 662, the NU 54 writes the resultant normalized radiance data over the older non-normalized radiance data in the NVM data structure 35. After step 662, the preferred method ends.

Figure 9:
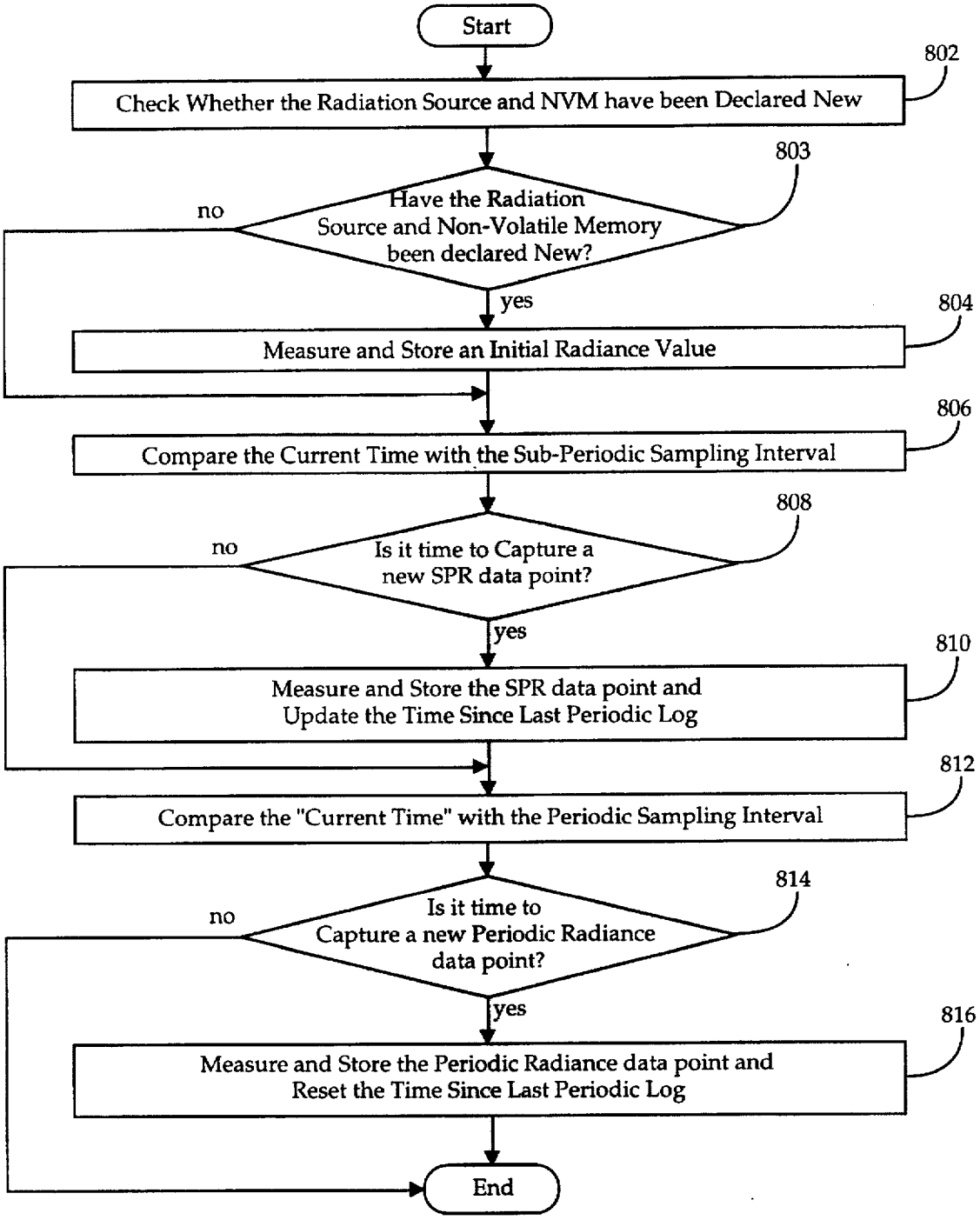
FIG. 9 is a flowchart of a preferred method for collecting radiance data.

Referring now to FIG. 9, a flowchart of a preferred method for collecting the radiance data (step 800 of FIG. 6) is shown. The preferred method begins in step 802 with the RMU 56 checking whether the radiation source 22 and NVM 34 have been declared new by inspecting the flag stored in the RAM 46 (step 612 of FIG. 7). If, in step 803, the radiation source 22 and the NVM 34 have been declared new, the method proceeds to step 804 where the RMU 56 measures the radiation source's 22 IR and stores the measured IR in the IR data field 80, after which the method proceeds to step 806. However, if, in step 803, the radiation source 22 and NVM 34 have not been declared new, the method proceeds directly to step 806. In step 806, the RMU 56 compares the current time as generated by the timer 40 with the sub-periodic sampling interval. Note, as was described earlier in this document, the sub-periodic sampling interval represents the time interval between successive updates of the SPR written to the SPR data field 78. If, in step 808, it is time to capture a new SPR data point, the method proceed to step 810 where the RMU 56 measures and stores the new SPR data point and updates the TSLPL data field 76 in the manner discussed above, after which the method proceeds to step 812. However, in step 808, if it was not time to capture the new SPR data point, the method proceeds directly to step 812. In step 812, the RMU 56 compares the current time with the periodic sampling interval (X). As was previously described, the periodic sampling interval (X) represents the time period between sequential periodic radiance data point captures. If, in step 814, it is time to capture a new periodic radiance data point, the method proceeds to step 816 where the RMU 56 measures and stores the new periodic radiance data point in either the PRX data field 82, or the PR2X data field 84 through PRnX data field 86, whichever is the next empty data field. In addition, in step 816, the RMU 56 resets the TSLPL in the TSLPL data field 76. After step 816, or after step 814 in the event that it is not time to capture the new periodic radiance data point, the preferred method ends.

Figure 10:
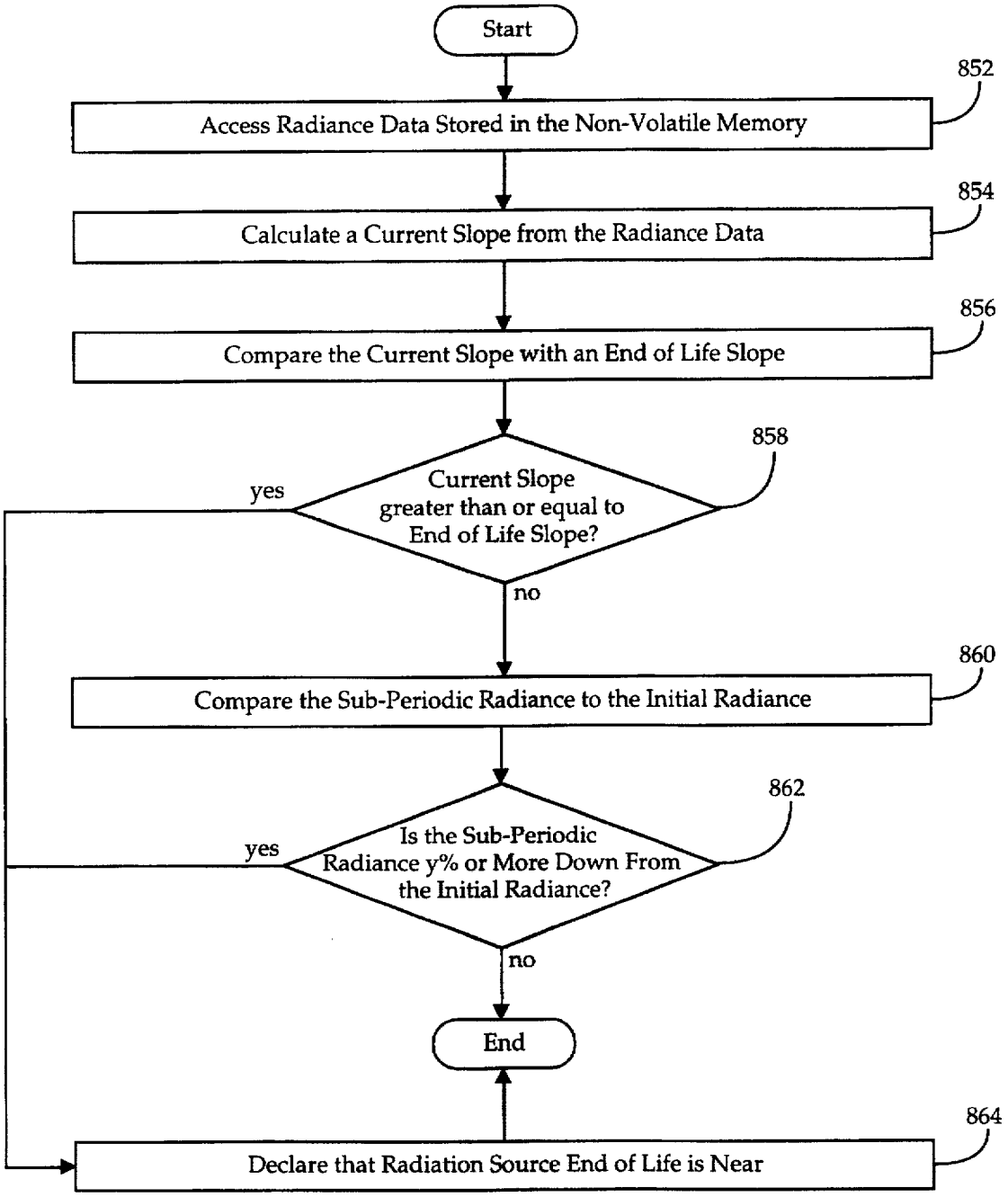
FIG. 10 is a flowchart of a preferred method for determining if the radiation source end of life is near.

Referring now to FIG. 10, a flowchart of a preferred method for checking if the radiation source 22 end of life is near (step 850 of FIG. 6) is shown. The preferred method begins in step 852 with the FPU 58 accessing all the radiance data stored in the operating log data field 74. In step 854, the FPU 58 calculates the current slope from the two most recently recorded radiance data points, in the manner discussed earlier in this document. In step 856, the FPU 58 compares the current slope with an end of life slope. The end of life slope is equivalent to the maximum allowable slope 60 discussed earlier. If, in step 858, the current slope is not greater than or equal to the end of life slope, the preferred method proceeds to step 860. However, in step 858, if the current slope is greater than or equal to the end of life slope, the method proceeds to step 864. In step 864, the FPU 58 declares that the radiation source's 22 end of life is near, after which the preferred method ends. In step 860 the FPU 58 compares the SPR to the IR. If, in step 862, the SPR is less than y% down from the IR, the method ends. However, in step 862, if the SPR is at least y% down from the IR, the method proceeds to step 864. In step 864, the FPU 58 declares that the radiation source's 22 end of life is near, after which, the preferred method ends.

While the present invention has been described with reference to certain preferred embodiments, those skilled in the art will recognize that various modifications may be provided. Variations upon and modifications to the preferred embodiments are provided for by the present invention, which is limited only by the following claims.

What is claimed is:

1. An apparatus for end of life warning, the apparatus comprising:

a radiation source, having a radiance;

a detector, responsive to the radiance;

a memory, having a radiance measurement unit comprising program instructions for collecting radiance data and a failure prediction unit comprising program instructions for determining that the radiation source end of life is near;

a non-volatile memory, for storing the radiance data, coupled physically to the radiation source and coupled electrically to the processing unit; and a processing unit, for executing the program instructions within the memory and coupled to the detector and the memory;

wherein the memory further comprises an initialization unit and a normalization unit.

2. A method for determining when an end of life of a radiation source is near, the method comprising the steps of:

collecting radiance data from the radiation source;

determining if the radiation source's end of life is near; and warning a user if the radiation source's end of life is near;

wherein the step of determining if the radiation source's end of life is near further comprises the steps of calculating a current slope from a subset of the radiance data;

comparing the current slope with an end of life slope; and declaring that the radiation source's end of life is near, if the current slope is greater than or equal to the end of life slope.

3. A method for determining when an end of life of a radiation source is near, the method comprising the steps of:

collecting radiance data from the radiation source;

determining if the radiation source's end of life is near; and warning a user if the radiation source's end of life is near;

wherein the step of determining if the radiation source's end of life is near further comprises the steps of calculating a current slope from a subset of the radiance data;

comparing the current slope with an end of life slope;

declaring that the radiation source's end of life is near, if the current slope is greater than or equal to the end of life slope;

comparing a sub-periodic radiance to an initial radiance; and declaring that the radiation source's end of life is near, if the sub-periodic radiance is a fixed percentage down from the initial radiance.

4. A method for determining when an end of life of a radiation source is near, the method comprising the steps of:

collecting radiance data from the radiation source, including the steps of;

checking a non-volatile memory coupled to the radiation source for an initialization symbol, performing the sub-steps of declaring the radiation source new, erasing the entire non-volatile memory, and writing the initialization symbol and a host serial number to the non-volatile memory, if the initialization symbol is not found, measuring and storing an initial radiance, if the radiation source has been declared new, and measuring and storing a periodic radiance, in a time determined by a periodic radiance interval, determining if the radiation source's end of life is near; and warning a user if the radiation source's end of life is near.

5. A method for determining when an end of life of a radiation source is near, the method comprising the steps of:

collecting radiance data from the radiation source, including the steps of;

retrieving a host serial number from a non-volatile memory coupled to the radiation source and a computer serial number from a computer coupled to the radiation source, recording the radiation source's current radiance, and normalizing the radiance data by the ratio of the current radiance to a sub-periodic radiance, if the host serial number is not equivalent to the computer serial number;

determining if the radiation source's end of life is near; and warning a user if the radiation source's end of life is near.

6. An apparatus for determining when an end of life of a radiation source is near, the apparatus comprising a:

means for collecting radiance data from the radiation source;

means for determining if the radiation source's end of life is near; and means for warning a user if the radiation source's end of life is near;

wherein the means for determining if the radiation source's end of life is near further comprises a means for calculating a current slope from a subset of the radiance data;

means for comparing the current slope with an end of life slope; and means for declaring that the radiation source's end of life is near, if the current slope is ≧ the end of life slope.

7. An apparatus for determining when an end of life of a radiation source is near, the apparatus comprising a:

means for collecting radiance data from the radiation source;

means for determining if the radiation source's end of life is near; and means for warning a user if the radiation source's end of life is near;

wherein the means for determining if the radiation source's end of life is near further comprises a means for calculating a current slope from a subset of the radiance data;

means for comparing the current slope with an end of life slope;

means for declaring that the radiation source's end of life is near, if the current slope is greater than or equal to the end of life slope;

means for comparing a sub-periodic radiance to an initial radiance; and means for declaring that the radiation source's end of life is near, if the sub-periodic radiance is more than a percentage down from the initial radiance.

8. An apparatus for determining when an end of life of a radiation source is near, the apparatus comprising a:

means for collecting radiance data from the radiation source;

means for determining if the radiation source's end of life is near; and means for warning a user if the radiation source's end of life is near;

wherein the means for collecting radiance data from the radiation source further comprises a means for checking a non-volatile memory coupled to the radiation source for an initialization symbol;

means for declaring the radiation source "new," erasing the entire non-volatile memory, and writing the initialization symbol and a host serial number to the non-volatile memory, if the initialization symbol is not found;

means for measuring and storing an initial radiance, if the radiation source has been declared "new"; and means for measuring and storing a periodic radiance, in a time determined by a periodic radiance interval.

9. An apparatus for determining when an end of life of a radiation source is near, the apparatus comprising a:

means for collecting radiance data from the radiation source;

means for determining if the radiation source's end of life is near;

means for warning a user if the radiation source's end of life is near;

means for retrieving a host serial number from a non-volatile memory coupled to the radiation source and a computer serial number from a computer coupled to the radiation source;

means for recording the radiation source's current radiance; and means for normalizing the radiance data by the ratio of the current radiance to a sub-periodic radiance, if the host serial number is not equivalent to the computer serial number.

10. A computer readable medium comprising programming instructions for:

collecting radiance data from a radiation source;

determining if the radiation source's end of life is near; and warning a user if the radiation source's end of life is near; wherein the instructions for determining if the radiation source's end of life is near further comprise programming instructions for calculating a current slope from a subset of the radiance data;

comparing the current slope with an end of life slope; and declaring that the radiation source's end of life is near, if the current slope is ≧ the end of life slope.

11. A computer readable medium comprising programming instructions for:

collecting radiance data from a radiation source;

determining if the radiation source's end of life is near; and warning a user if the radiation source's end of life is near;

wherein the instruction for determining if the radiation source's end of life is near further comprise programming instructions for:

calculating a current slope from a subset of the radiance data;

comparing the current slope with an end of life slope;

declaring that the radiation source's end of life is near, if the current slope is greater than or equal to the end of life slope;

comparing a sub-periodic radiance to an initial radiance; and declaring that the radiation source's end of life is near, if the sub-periodic radiance is a fixed percentage below the initial radiance.

12. A computer readable medium comprising programming instructions for:

collecting radiance data from a radiation source;

determining if the radiation source's end of life is near; and warning a user if the radiation source's end of life is near; wherein the instructions for collecting radiance data from the radiation source further comprise programming instructions for checking a non-volatile memory coupled to the radiation source for an initialization symbol;

declaring the radiation source "new," erasing the entire non-volatile memory, and writing the initialization symbol and a host serial number to the non-volatile memory, if the initialization symbol is not found;

measuring and storing an initial radiance, if the radiation source has been declared "new"; and measuring and storing a periodic radiance, in a time determined by a periodic radiance interval.

13. A computer readable medium comprising programming instructions for:

collecting radiance data from a radiation source, including the steps of retrieving a host serial number from a non-volatile memory coupled to the radiation source and a computer serial number from a computer coupled to the radiation source, recording the radiation source's current radiance, and multiplying the radiance data by the ratio of the current radiance to a sub-periodic radiance, if the host serial number is not equivalent to the computer serial number;

determining if the radiation source's end of life is near; and warning a user if the radiation source's end of life is near.

14. An apparatus for end of life warning of a projection unit, the apparatus comprising:

a radiation source having a radiance;

a detector responsive to said radiance;

a computer having a radiance measurement unit for collecting radiance data from said detector and having a failure prediction unit for determining whether said radiation source end of life is near; and a non-volatile memory connectable to said computer for storing said radiance data;

wherein said computer inhibits the operation of said radiation source if said non-volatile memory is not connected to said computer.

15. The apparatus of claim 14, wherein:

said detector is an infrared detector.

16. The apparatus of claim 14, wherein:

said projection unit has a housing and said computer is disposed within said housing.

17. An apparatus for end of life warning of one or more projection units, the apparatus comprising:

a radiation source having a radiance;

a detector responsive to said radiance;

a computer having a radiance measurement unit for collecting radiance data from said detector and a failure prediction unit for determining whether said radiation source end of life is near; and a non-volatile memory for storing said radiance data;

wherein said apparatus for end of life warning is exchangeable between said projection units.

18. The apparatus of claim 17, wherein:

said computer generates a warning signal upon determining that said radiance is below a fixed percentage of an initial radiance.

19. An apparatus for end of life warning of a device containing a radiation source having a radiance, the apparatus comprising:

a detector responsive to said radiance; and a computer having a random access memory, a read only memory storing program instructions for collecting radiance data and for determining that said radiation source end of life is near, and a processing unit for executing said program instructions and for generating a warning signal upon determining either that said radiance is below some fixed percentage of an initial radiance and that the current slope of said radiance data is greater than or equal to an end of life slope.

20. The apparatus of claim 19, wherein:

said computer has a timer, said programming instructions determine multiple times for collecting said radiance data, and said random access memory stores said radiance data.

* * * * *